US007913709B2

(12) United States Patent
Brebner

(10) Patent No.: US 7,913,709 B2
(45) Date of Patent: Mar. 29, 2011

(54) UMBRELLA

(75) Inventor: Greig Reid Brebner, Auckland (NZ)

(73) Assignee: GB Design Limited, Auckland (NZ)

( * ) Notice: Subject to any disclaimer, the term of this patent is extended or adjusted under 35 U.S.C. 154(b) by 607 days.

(21) Appl. No.: 10/579,656

(22) PCT Filed: Nov. 16, 2004

(86) PCT No.: PCT/NZ2004/000292
§ 371 (c)(1),
(2), (4) Date: Mar. 29, 2007

(87) PCT Pub. No.: WO2005/048765
PCT Pub. Date: Jun. 2, 2005

(65) Prior Publication Data

US 2007/0272288 A1 Nov. 29, 2007

(30) Foreign Application Priority Data

Nov. 18, 2003 (NZ) ..... 529621

(51) Int. Cl.
*A45B 25/18* (2006.01)
*A45B 15/00* (2006.01)

(52) U.S. Cl. ..... 135/33.5; 135/33.2; 135/31; 135/33.41

(58) Field of Classification Search ..... 135/27, 135/28, 31, 33.2, 33.4, 33.41, 33.5
See application file for complete search history.

(56) References Cited

U.S. PATENT DOCUMENTS 2,047,711 A * 7/1936 Siers ..... 135/23
2,185,587 A * 1/1940 Carlisle ..... 135/33.5
3,513,863 A 5/1970 Weber
4,030,515 A 6/1977 Weber
4,259,974 A 4/1981 de Polo
4,474,201 A * 10/1984 Kida ..... 135/26
4,638,827 A 1/1987 DeMarco
4,711,260 A * 12/1987 Wiens et al. ..... 135/16
(Continued)

FOREIGN PATENT DOCUMENTS

DE 20215089 12/2002
(Continued)

*Primary Examiner* — David Dunn
*Assistant Examiner* — Danielle Jackson
(74) *Attorney, Agent, or Firm* — Dann, Dorfman, Herrell and Skillman, P.C.

(57) ABSTRACT

An umbrella (1) in which the canopy is supported, tensioned and retained on a frame without any external points. The ends of conventional ribs (6,7) are provided with force spreading components (8) which are located within pockets (9) at the periphery of the umbrella canopy (3). As the umbrella is erected, the force spreading components open to provide a surface which pushes outwardly against a bearing surface formed between a pocket and the canopy, which "spread" outwards. The spreading of the components (8) is initiated by the radially outward movement of slidable tubes (7) upon inner rods (6) attached at their inner ends to the shaft (2) of the umbrella. Inner rods (6) and outer tubes (7) together form the ribs or spokes of the umbrella which are supported and raised/lowered by primary struts (11) connected between the ribs and a primary shaft slider (12). Outward sliding movement of the outer tubes (7) over the inner rods (6) is assisted by secondary struts (13) which connect a secondary shaft slider (14) (positioned between the primary shaft slider (12) and the canopy end of the shaft) and a respective primary strut (11).

67 Claims, 11 Drawing Sheets

U.S. PATENT DOCUMENTS

| | | | | |
|---|---|---|---|---|
| 5,595,202 | A * | 1/1997 | Scaccia | 135/33.6 |
| 5,694,958 | A * | 12/1997 | Chang | 135/33.5 |
| 6,401,737 | B1 | 6/2002 | Kloor, III | |

FOREIGN PATENT DOCUMENTS

| | | |
|---|---|---|
| EP | 86305309.6 A1 | 1/1988 |
| GB | 2344286 | 6/2000 |
| JP | 58022003 | 2/1983 |
| JP | 58163306 | 9/1983 |
| JP | 252610 | 4/1990 |
| JP | 9065916 | 3/1997 |
| NL | 6810620 | 1/1969 |
| NZ | 335082 | 10/1997 |
| WO | WO 00/76356 | 12/2000 |

* cited by examiner

UMBRELLA

TECHNICAL FIELD

This invention relates to umbrellas and in particular though not solely to canopy extension and tensioning mechanisms for umbrellas.

BACKGROUND ART

Umbrellas may be used to protect a user from the sun, wind or rain and may be portable or designed to be fixed to the ground (such as sun umbrellas having generally larger dimensions than portable rain umbrellas).

Fundamentally, the basic design of umbrellas has not changed in the past three centuries. Conventional umbrellas include a shaft to which a canopy is attached at one end and a handle is attached at the other end. A collapsible frame is included to support the canopy and which, when not in use, allows itself and the canopy to be lowered into a more compact state which may more easily be stored.

The collapsible frame consists of a number of ribs (usually eight ribs) evenly radially distributed about the shaft and pivotally connected at their inner ends to the canopy end of the shaft. The perimeter of the canopy is attached (often simply tied by threads) to the outer ends of each of the ribs. The end of each rib is generally exposed and provided with a stopper or other blunting device. In many umbrellas, in order to assist in raising/lowering the ribs and holding them in position, each rib is provided with a brace or strut which is pivotally connected at one of its ends to a point along the rib's length and at its other end it is pivotally connected to a slider which is slidable along the shaft. The slider is lockable in position near the canopy end of the shaft when in use.

Minor improvements have been made to the above described basic umbrella design for improved user convenience. Improvements include push-button self-erecting mechanisms usually incorporating a spring in which energy stored during collapsing of the umbrella is utilised to move the slider up the shaft to thereby erect the umbrella. Another relatively recent improvement is the provision of umbrellas which "fold down" to fit within a hand bag or briefcase for example. Umbrellas of this variety usually include a multi-segment shaft in which successive segments are a slide-fit within preceding segments. Further reductions in size are achieved by the use of multi-segmented canopy supporting ribs which are pivotally connected together and are collapsible in 'V' or 'W' shaped formations.

Problems with the above described conventional design (and its minor improvements) include the exposed rib ends which when in use, are positioned at or about eye level of passers-by and therefore pose a safety hazard. Also, in strong wind conditions the canopy may become detached from the frame while the frame has a tendency to turn inside-out, often resulting in irreparable damage to the umbrella frame and/or canopy.

It is also noted that in most if not all conventional umbrella designs, the canopy material is not optimally tensioned. This is because during erection of umbrellas having conventional frame designs, the vertical force provided by the user on the shaft slider is converted to compressive forces acting on the struts which in turn inefficiently convert the vertical force into a radially outwardly directed canopy tension. As the umbrella approaches its completely erect state, the struts (which support the ribs) approach the horizontal such that the majority of the effort being exerted by the user (the horizontal component of the strut force) is not being used while only a small proportion of the user's effort (the vertical component of the strut force) is usefully being employed in the tensioning the canopy. This is readily observed when erecting conventional umbrellas in which resistance to shaft slider movement becomes increasingly apparent at the end of the slider's travel despite the rate of change of angle between rib and shaft reducing. Accordingly, in conventional umbrella designs, tension which could usefully be employed in the canopy is wasted in the ribs.

It would also be an advantage if an umbrella and/or umbrella frame could be developed in which the canopy could easily be replaced should it be desired or necessary.

It is therefore an object of the present invention to provide an umbrella and/or umbrella frame which will go at least some way towards overcoming the above disadvantages or addressing the above problems or which will at least provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

DISCLOSURE OF INVENTION

Accordingly, in a first aspect the invention consists in an umbrella comprising:

a shaft, a plurality of rib members, first ends of said rib members spaced about and pivotally connected at or adjacent a first end of said shaft, a canopy including pocket means at or adjacent to the periphery of the canopy wherein an opening or openings in the pocket means is accessible from the direction of the central portion of the canopy, a sliding means movable along the shaft to erect or collapse the umbrella, a plurality of struts, each of which is pivotally connected between the sliding means and a rib member, and force spreading means provided on a second end of each rib member, the force spreading means received within the pocket means of the canopy.

Preferably, the inside of the or each pocket means, at least opposite to the opening, is closed to provide a bearing surface upon which the force spreading means contacts.

Preferably, said pocket means comprise a plurality of separate pockets spaced about the canopy's periphery, wherein one force spreading means is received within each pocket.

Preferably, a closed edge of each pocket lies along the periphery of the canopy and the opening in each pocket is in the form of a slit substantially aligned with its rib member.

Preferably, the periphery of each pocket is closed.

Preferably, a secondary sliding means movable along the shaft between said sliding means and the first end of said shaft, and a plurality of secondary struts each pivotally connected between said secondary sliding means and a respective strut are also provided.

Preferably, said secondary struts are about half as long as the struts.

Preferably, said secondary struts are about 15/26 times the length of the struts.

Preferably, each secondary strut is connected to a strut a pre-determined distance from its connection with said sliding means, wherein said pre-determined distance is substantially equal to the length of said secondary strut.

Preferably, the sliding means includes a spacing means above the position on the sliding means at which the struts are connected and which, during erection of the umbrella, contacts and pushes the secondary sliding means and once the umbrella has reached a fully erected state, fixes the spacing between the sliding means and secondary sliding means.

Preferably, during erection of the umbrella, holding means temporarily hold the secondary sliding means in position at a predetermined location along the shaft before releasing the secondary sliding means once the sliding means has moved a predetermined distance towards the secondary sliding means.

Preferably, each rib member includes an inner rod means extending between the shaft and a force spreading means and an outer tube slidable on said inner rod means wherein each outer tube is pivotally connected to a strut.

Preferably, each force spreading means includes a load spreading surface adapted to transfer radial force from the outer tube of said rib member to the periphery of said canopy via said pocket means.

Preferably, the amount of contact between said canopy and said load spreading surface increases during erection of said umbrella.

Preferably, said force spreading means comprises two legs pivotally connected together at a pivot region and forming a substantially 'V' shape when said umbrella is in a collapsed state and wherein said legs are spread apart and substantially aligned during erection of said umbrella, the two legs and the pivot region forming said load spreading surface.

Preferably, the outer end of an inner rod means contacts the pivot region of a force spreading means and the outer end of an outer tube is connected to both of the legs of said force spreading means.

Preferably, the outer end of an inner rod means is received within a longitudinal bore provided in a stopper connected to or forming a part of the pivot region of a force spreading means.

Preferably, each force spreading means includes first and second spreading members, each pivotally connected to a respective pivotally connected leg and non-pivotally connected to a tube mounting hub of said force spreading means, the tube mounting hub connected to the outer end of said outer tube, said inner rod means passing through the tube mounting hub.

Preferably, said force spreading means is formed from a plastics material and wherein living hinges form the pivotal connections therein.

Preferably, the inner rod means comprises more than one separate inner rod portion placed end to end within an outer tube.

Preferably, an inner rod portion furthest from the shaft has a lower weight per unit length than an inner rod portion closer to the shaft.

Preferably, no more than six rib members are provided about said shaft.

In a second aspect, the invention consists in an umbrella frame comprising:

a shaft, a plurality of rib members, first ends of said rib members spaced about and pivotally connected at or adjacent a first end of said shaft, a primary sliding means movable along the shaft to erect or collapse the umbrella frame, a secondary sliding means movable along the shaft between the primary sliding means and the first end of the shaft, a plurality of primary struts, each of which is pivotally connected between the primary sliding means and a rib member, and a plurality of secondary struts, each of which is pivotally connected between the secondary sliding means and a primary strut.

Preferably, a force spreading means is provided on a second end of each rib member.

Preferably, said secondary struts are about half as long as the primary struts.

Preferably, said secondary struts are about 15/26 times the length of the primary struts.

Preferably, each secondary strut is connected to a primary strut a pre-determined distance from its connection with said primary sliding means, wherein said pre-determined distance is substantially equal to the length of said secondary strut.

Preferably, the primary sliding means includes a spacing means above the position on the primary sliding means at which the primary struts are connected and which, during erection of the umbrella frame, contacts and pushes the secondary sliding means and once the umbrella frame has reached a fully erected state, fixes the spacing between the primary sliding means and secondary sliding means.

Preferably, during erection of the umbrella frame, holding means temporarily hold the secondary sliding means in position at a predetermined location along the shaft before releasing the secondary sliding means once the primary sliding means has moved a predetermined distance towards the secondary sliding means.

Preferably, each rib member includes an inner rod means extending between the shaft and a force spreading means and an outer tube slidable on said inner rod means wherein each outer tube is pivotally connected to a primary strut.

Preferably, a force spreading means is provided on a second end of each rib member, each force spreading means including a load spreading surface adapted to transfer radial force from the outer tube of said rib member to the periphery of a canopy adapted to be supported by the umbrella frame.

Preferably, the effective length or contact area of said load spreading surface increases during erection of said umbrella frame.

Preferably, said force spreading means comprises two legs pivotally connected together at a pivot region and forming a substantially 'V' shape when said umbrella frame is in a collapsed state and wherein said legs are spread apart and substantially aligned during erection of said umbrella frame, the two legs and the pivot region forming said load spreading surface.

Preferably, the outer end of an inner rod means contacts the pivot region of a force spreading means and the outer end of an outer tube is connected to both of the legs of said force spreading means.

Preferably, the outer end of an inner rod means is received within a longitudinal bore provided in a stopper connected to or forming a part of the pivot region of a force spreading means.

Preferably, each force spreading means includes first and second spreading members, each pivotally connected to a respective pivotally connected leg and non-pivotally connected to a tube mounting hub of said force spreading means, the tube mounting hub connected to the outer end of said outer tube, said inner rod means passing through the tube mounting hub.

Preferably, said force spreading means is formed from a plastics material and wherein living hinges form the pivotal connections therein.

Preferably, the inner rod means comprises more than one separate inner rod portion placed end to end within an outer tube.

Preferably, an inner rod portion furthest from the shaft has a lower weight per unit length than an inner rod portion closer to the shaft.

Preferably, no more than six rib members are provided about said shaft.

In a third aspect, the invention consists in an umbrella frame comprising:

a shaft, a plurality of rib members spaced about said shaft, each rib member including a first portion pivotally connected at or adjacent a first end of said shaft and a second portion freely slidable relative to said first portion, a sliding means movable along the shaft to erect or collapse the umbrella frame, and a plurality of struts, each of which is pivotally connected between the sliding means and the second portion of said rib member.

Preferably, a secondary sliding means movable along the shaft between said sliding means and the first end of said shaft, and a plurality of secondary struts each pivotally connected between said secondary sliding means and a respective strut are also provided.

Preferably, said secondary struts are about half as long as the struts.

Preferably, said secondary struts are about 15/26 times the length of the struts.

Preferably, each secondary strut is connected to a strut a pre-determined distance from its connection with said sliding means, wherein said pre-determined distance is substantially equal to the length of said secondary strut.

Preferably, the sliding means includes a spacing means above the position on the sliding means at which the struts are connected and which, during erection of the umbrella frame, contacts and pushes the secondary sliding means and once the umbrella frame has reached a fully erected state, fixes the spacing between the sliding means and secondary sliding means.

Preferably, during erection of the umbrella frame, holding means temporarily hold the secondary sliding means in position at a predetermined location along the shaft before releasing the secondary sliding means once the sliding means has moved a predetermined distance towards the secondary sliding means.

Preferably, a force spreading means is provided on the end of each rib member furthest from the shaft.

Preferably, the first portion of each rib member includes an inner rod means extending between the shaft and a force spreading means and an outer tube slidable on said inner rod means wherein each outer tube is pivotally connected to a strut.

Preferably, each force spreading means includes a load spreading surface adapted to transfer radial force from the outer tube of said rib member to the periphery of a canopy adapted to be supported by the umbrella frame.

Preferably, the effective length or contact area of said load spreading surface increases during erection of said umbrella frame.

Preferably, said force spreading means comprises two legs pivotally connected together at a pivot region and forming a substantially 'V' shape when said umbrella frame is in a collapsed state and wherein said legs are spread apart and substantially aligned during erection of said umbrella frame, the two legs and the pivot region forming said load spreading surface.

Preferably, the outer end of an inner rod means contacts the pivot region of a force spreading means and the outer end of an outer tube is connected to both of the legs of said force spreading means.

Preferably, the outer end of an inner rod means is received within a longitudinal bore provided in a stopper connected to or forming a part of the pivot region of a force spreading means.

Preferably, each force spreading means includes first and second spreading members, each pivotally connected to a respective pivotally connected leg and non-pivotally connected to a tube mounting hub of said force spreading means, the tube mounting hub connected to the outer end of said outer tube, said inner rod means passing through the tube mounting hub.

Preferably, said force spreading means is formed from a plastics material and wherein living hinges form the pivotal connections therein.

Preferably, the inner rod means comprises more than one separate inner rod portion placed end to end within an outer tube.

Preferably, an inner rod portion furthest from the shaft has a lower weight per unit length than an inner rod portion closer to the shaft.

Preferably, no more than six rib members are provided about said shaft.

In a further aspect, the invention consists in an umbrella including a canopy supported by an umbrella frame according to the second or third aspects.

Preferably, the canopy includes pocket means at or adjacent to the periphery of the canopy wherein an opening or openings in the pocket means is accessible from the direction of the central portion of the canopy.

Preferably, the inside of the or each pocket means, at least opposite to the opening, is closed to provide a bearing surface upon which the force spreading means contacts.

Preferably, a force spreading means is provided on the end of each rib member furthest from the shaft, wherein said pocket means comprise a plurality of separate pockets spaced about the canopy's periphery, and wherein one force spreading means is received within each pocket.

Preferably, a closed edge of each pocket lies along the periphery of the canopy and the opening in each pocket is in the form of a slit substantially aligned with its rib member.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
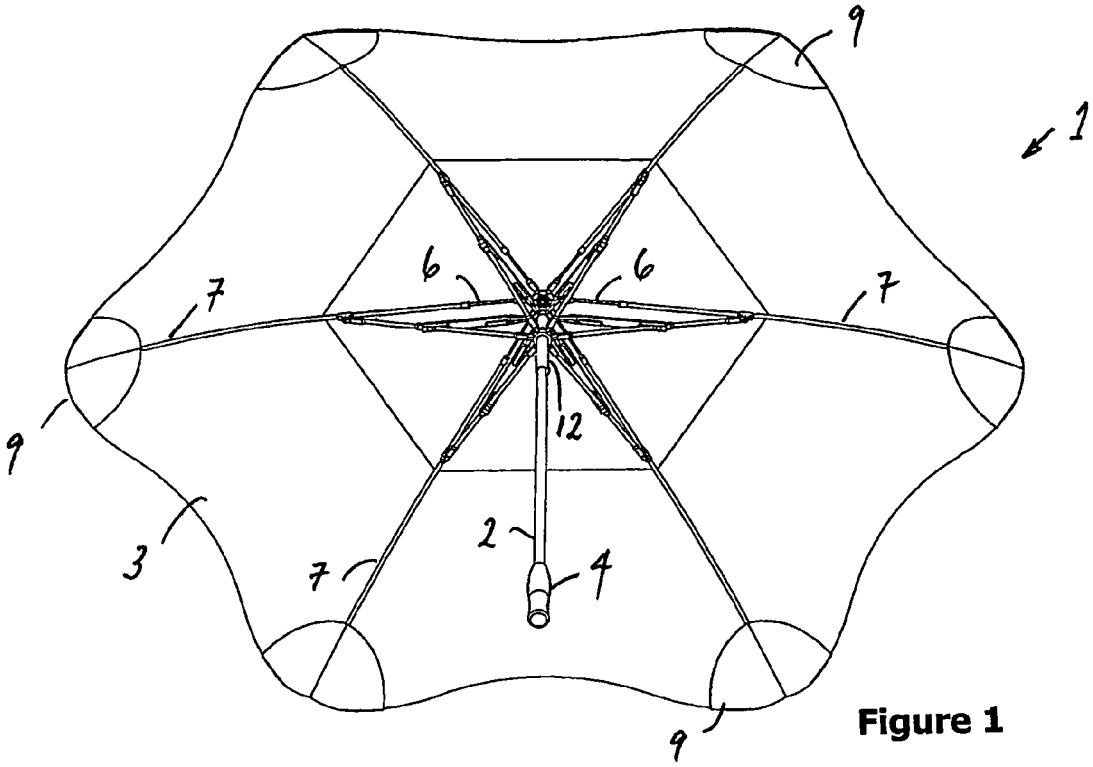
FIG. 1 is a perspective view from beneath of an umbrella according to a preferred embodiment of the present invention.
Figure 2:
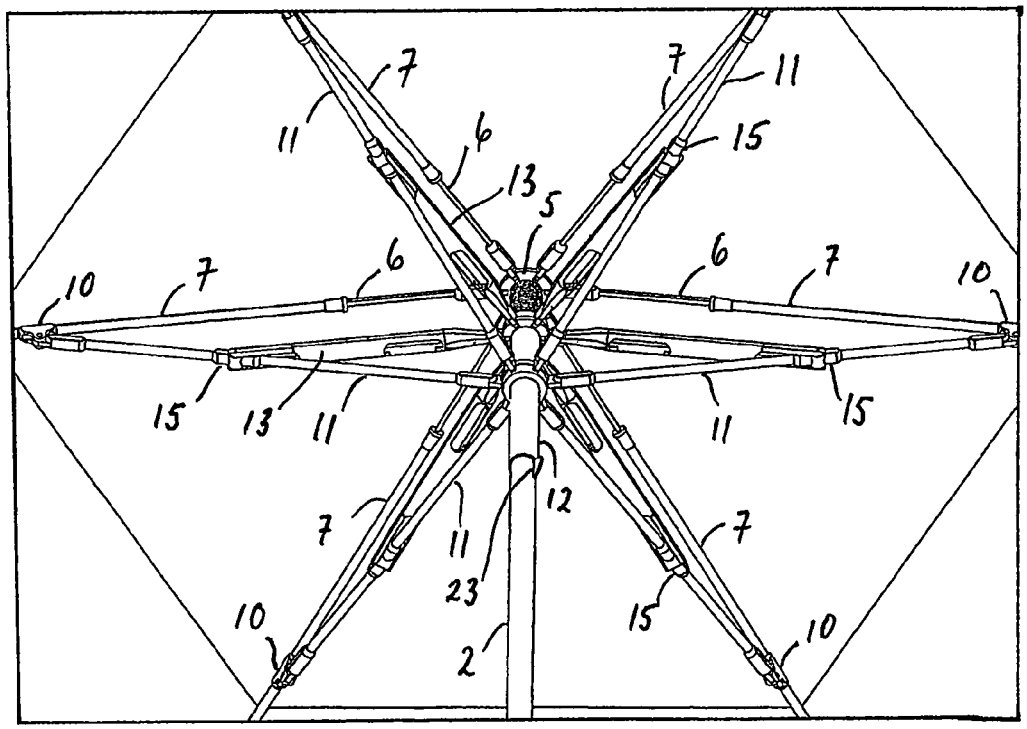
FIG. 2 is an enlarged perspective view of the main components of the canopy extending and tensioning means or mechanism of the umbrella of FIG. 1, FIGS. 3A to 3E are a series of perspective views from the front and slightly above of the umbrella of FIG. 1 without its canopy, showing the actions of the components of the canopy extending and tensioning mechanism at various stages during erection of the umbrella.

With reference to the drawings and in particular FIGS. 1 and 2 initially, an umbrella 1 according to the present invention is shown. Umbrella 1 includes a frame having a shaft 2 with a canopy 3 at or adjacent or proximate to one end and a handle 4 at the opposite end of the shaft. Shaft 2 may be solid or hollow and may be cylindrical or have an alternative cross-sectional shape such as square, hexagonal or octagonal. The frame includes a canopy extending/retracting and tensioning means or mechanism at the canopy end of shaft 2, the structure of which is described below.

As most clearly shown in FIG. 2, at or near the canopy end of shaft 2 a rose or circular flange or washer 5 is provided. Washer 5 is axially fixed and non-slidable on shaft 2. A plurality of ribs or spokes 6 are pivotally connected to and preferably equally radially spaced about washer 5. Due to the added structural strength provided by the construction of the present invention (as will be evident from the ensuing description), even for large "golfing"-type umbrellas, no more than six ribs 6,7 need be provided about washer 5 although more than six ribs may be provided.

Each rib comprises an inner rod 6 extending between washer 5 and a force spreading means or spreader 8 (not visible in FIGS. 1 and 2 but explained below with reference to FIGS. 5A to 5E) which is hidden within pocket means such as individual pockets 9 spread evenly, or spaced corresponding to the spacing of the ribs, about the periphery of the underside of canopy 3. Each pocket 9 has an opening to allow for the insertion/removal of a spreader 8 but at least the edge of pocket 9 along the periphery of cover 3 is closed to provide a bearing line or surface for each spreader to contact. The pocket openings face the central portion of the canopy so that a spreader may be positioned within the pocket. For example, the opening may be formed as a slit in the pocket with the slit substantially aligned with a rib 6,7 and sized to allow entry of a (closed or compressed) spreader 8.

Alternatively, pockets 9 could be replaced by a single pocket extending about the entire periphery of the canopy. Such a pocket could for example simply be formed by sewing a thin strip (for example, a few centimeters wide) to the underside of the canopy around the periphery of the canopy.

Each inner rod 6 may be made of a single rod or may comprise a plurality of (for example two) contiguous or abutable but separate rods in touching contact, end to end. In this way, a first inner rod having particular physical properties (such as relative inflexibility) such as a 2 mm diameter steel rod can form the section of inner rod closest to the shaft but a more lightweight and flexible rod material (such as fiberglass) may form the section of inner rod furthest from the shaft where greater bending force is expected. In this way, overall weight can be reduced by selecting a material for the outer rod portion with a lower weight per unit length than the inner rod portion. The two or more sections of inner rod 6 may, for example, be of equal length.

An outer tube 7 is provided about and slidable along each inner rod 6 at or near its end furthest from shaft 2. The inner rods 6 and outer tubes 7 should have a complimentary cross-sectional shape to allow the outer tube 7 to slide along the inner rod 6. Preferably the inner rod 6 and outer tube 7 are circular in cross-section but other shapes such as square, hexagonal or octagonal could be used. The inner rod is preferably coaxial with outer tube 7.

Each outer tube 7 is provided with a coupling 10, which may be formed from polycarbonate, and which pivotally receives the outer end of a primary strut 11. Coupling 10 is preferably positioned on or around each outer tube 7 at a distance from the shaft which is about the same or slightly shorter that the length of a primary strut. For example, if each primary strut had a length of about 26 cm then the coupling 10 could be positioned around 21 cm from the shaft end of the rib, on the outer tube 7 (when the umbrella is in its fully lowered or collapsed state). Although the inner end of each outer tube 7 could coincide with the location of coupling 10, it is preferred that the outer tube extend inwards beyond the coupling 10 to reduce the length of exposed inner rod 6. As will be appreciated from the ensuing description, the exposed section of inner rod 6 contacts the canopy 3 and therefore affects the appearance of the erected umbrella's profile and, from above the canopy, a discontinuity in the canopy's curve may be visible between outer tube 7 and rod 6. More importantly however, allowing the inner ends of outer tubes 7 to coincide with the outer ends of primary struts 11 has been found to create a potential pivot point for the ribs 6,7 to invert. In comparison, by having a continuous stiffness through this potential pivot point (by extending the outer tube inwards of the outer end of the primary strut) the ribs are less likely to pivot thereby increasing the umbrella's ability to withstand inversion. The inner ends of outer tubes 7 may be provided with end caps (as shown in the drawings) to resist the inner ends of the tubes catching on the canopy fabric as they slide over it. The end caps will of course require a central hole to allow for passage of the inner rod therethrough.

It may also be desirable to cover the exposed inner portions of the inner rods 6 with a relatively stiff tube, formed from example 8 mm diameter polycarbonate tubing. The stiff tube could simply be an extension of a moulding coupling the inner rod to washer 5. The stiff tube would extend outwards sufficiently to always extend beyond the inner end of the outer tube 7 which would be slidable within the stiff tube. It is anticipated that the stiff tube would provide an improvement in the continuity of the curve of the canopy between the shaft and the outer rods.

The inner end (that is closest to shaft 2) of each primary strut 11 is pivotally connected by a coupling to an annulus 12C about a primary sliding means or primary slider 12 which is slidable along shaft 2. Movement of primary slider 12 (either manually or spring assisted in the case of "automatic" umbrellas) up and down shaft 2 causes the umbrella to be erected or collapsed respectively. Conventional locking means such as a spring-loaded shaft protrusion 26 may be provided on the shaft to enable sliding means 12 to be retained in position such that the umbrella may be locked in its erected state. It can be seen that primary slider 12 includes a lower cylindrical user gripping portion 12A and an upper cylindrical spacing portion 12B, the significance of which will be explained below.

In order to improve the ease with which the umbrella may be erected, a secondary strut 13 is connected between a substantially mid-point of each primary strut 11 and a secondary sliding means or slider 14 (not labelled in FIG. 1 or FIG. 2) which is slidable on shaft 2 between washer 5 and primary slider 12. The connection between secondary strut 13 and primary strut 11 allows relative pivotal movement therebetween. In the embodiment shown, a connection ring or tube 15 which may for example be formed from polycarbonate, polypropylene or high density polyethylene is fixed to the primary strut 11 about half way along (more preferably, between about 0.5 and 0.6 of the way along and even more preferably, about 15/26 of the way along) its length and the outer end of secondary strut 13 is forked with both prongs pivotally connected to connection ring 15 by a pin. The connection between secondary strut 13 and secondary slider 14 therefore allows pivotal relative movement therebetween.

Each secondary strut 13 may be "U" shaped in cross-section or generally convex to allow its associated primary strut 11 to be accommodated therein when the umbrella is in its collapsed state in order to minimise the volume of the collapsed frame. Cut out portions may also be provided in the secondary struts to accommodate couplings 10 when in the collapsed state. It will be appreciated that secondary struts 13 and secondary slider 14 reduce the effort required by a user in erecting the umbrella as they initiate the outwards sliding of the outer tubes 7. However, other mechanisms for initiating this translational movement could be equally effective.

A biasing means such as spring 23 may be provided about the shaft 2 between washer 5 and secondary slider 14. Spring 23 assists the operator to avoid "over-shooting" by pushing the primary slider 12 too far during erection of the umbrella but also may assist in avoiding any loose movement of the sliders (that is, the spring will effectively take up any "slack" in the sliders' movement). The spring constant of spring 23 is therefore not required to be very large, especially as the spring must be compressed during erection of the umbrella and it is desired that the user need not exert excessive force to compress the spring.

Washer 5, primary 12 and secondary 14 sliders may all be manufactured from rigid plastics material such as polypropylene, high density polyethylene or polycarbonate. Shaft 2, primary struts 11, inner rods 6 and outer tubes 7 may be formed from fibreglass pultrusion or folded/rolled metal. Preferably, inner rods 6 (and to a lesser extent outer tubes 7) are manufactured from a flexible or elastically bendable material to allow the canopy to assume a curved shape once erected. As previously mentioned, inner rods 6 may include a less flexible inner portion formed for example from steel rod. Secondary struts 13 may be formed from a rigid plastics material or folded metal.

Canopy 3 may be formed from any conventional wind/rain/sun-proof fabric such as canvas or nylon. The dimensions of the canopy are arranged so that the distance from the centre of the canopy to the furthest point within each pocket 9 is substantially equal to the distance from the shaft to the outermost point of a spreader 8.

The operation of the canopy extending/retracting and tensioning mechanism of the umbrella will now be described with reference to FIGS. 3A to 3E, 4A to 4E, 5A to 5E and 6A to 6E.

Figure 5A:
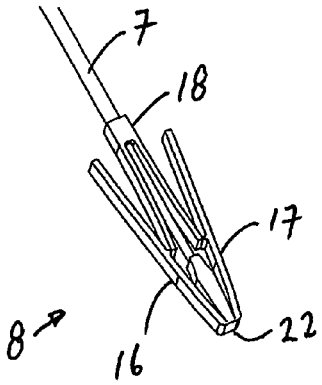
Figure 5B:
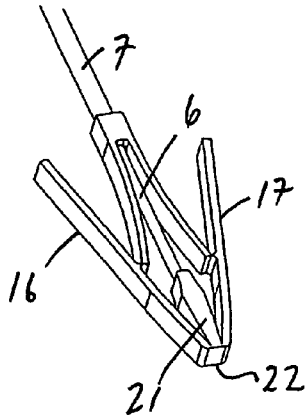
Figure 5C:
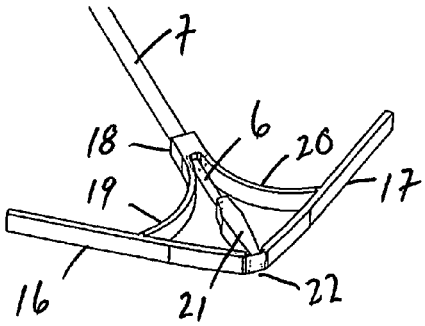
Figure 5D:
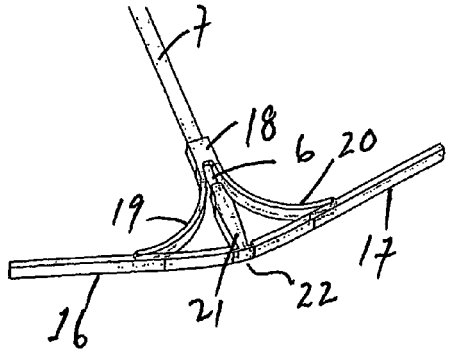

With reference firstly to FIGS. 5A to 5E it can be seen that each spreader 8 includes first 16 and second 17 legs pivotally connected at a pivot region 22. In the umbrella's collapsed state as shown in FIG. 5A, legs 16 and 17 are positioned in a substantially "V" shaped formation. The outer end of outer tube 7 is held captive (by adhesive or a grub screw for example) within a tube mounting hub 18 having forked legs 19 and 20 bendably extending from the tube mounting hub 18 to their distal ends which pivotally connect to respective legs 16 and 17. Tube mounting hub 18 includes a central passage through which the outer end of an inner rod 6 is passed before terminating in stopper 21, the end of which is coterminous or integrally formed with the pivot region 22 between legs 16 and 17. Stopper 21 is formed as an elongate member having a central longitudinal bore commensurate in diameter with the end of inner rod 6. The end of inner rod 6 is preferably slidable within stopper 21.

Spreader 8 may be integrally formed from a plastics material such as random copolymer polypropylene with each of the pivotal connections (between pivot 22 and legs 16, 17 and between legs 16, 17 and legs 19, 20) formed as living hinges.

Figure 5E:
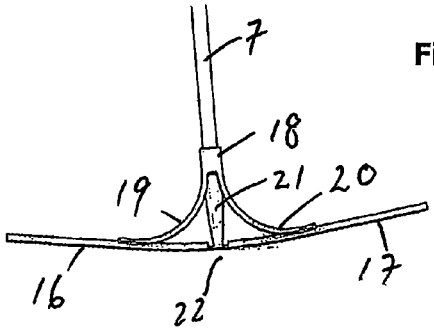

As the outer end of outer tube 7 slides along inner rod 6 towards the outer end of the rib, it can be seen in FIGS. 5A to 5E that legs 16 and 17 are splayed or spread until in FIG. 5E the legs form a substantially straight line or a "T" shape with outer tube 7 when outer tube 7 reaches the end of its travel and tube mounting hub 18 contacts stopper 21. Additional radial outwards movement of outer tube 7 will move the entire spreader outward with respect to inner rod 6 and shaft 2 until restrained by the canopy, thereby tensioning the canopy. In practice, legs 16 and 17 will bend in an arc or substantially "U" shape when acting to tension the canopy from within pockets 9 as the pockets are convex to allow tensioning force from spreader 8 to be smoothly applied to the canopy periphery. As previously mentioned, inner rod 6 slides within stopper 21 and it will be appreciated that in order for the stopper to be retained on the inner rod and for the spreading action illustrated in FIGS. 5A to 5E to occur, a force must be applied radially inwardly at pivot region 22 and this is provided by the bearing or contact surface within the canopy pockets 9.

Figure 3A:
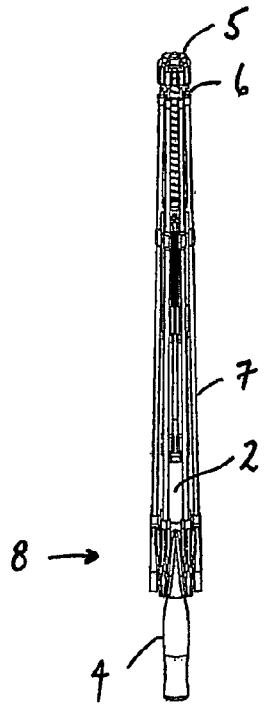
Figure 4A:
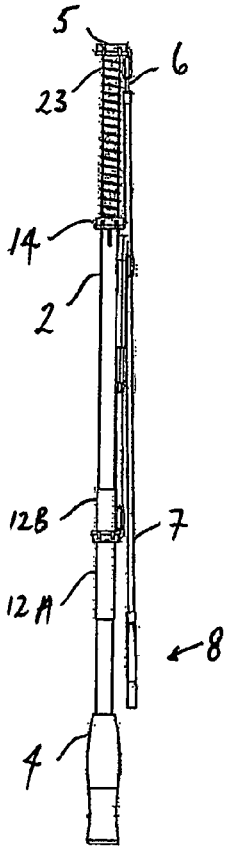
FIGS. 4A to 4E are a series of side elevational views corresponding to FIGS. 3A to 3E showing the action of a single rib and its associated struts and sliders at various stages during erection of the umbrella of FIG. 1, and FIGS. 5A to 5E are a series of perspective views of the force spreading means of the umbrella of FIG. 1 at various stages during erection of the umbrella of FIG. 1, FIGS. 6A to 6E are a series of front elevational views corresponding to FIGS. 3A to 3E and 4A to 4E showing the action of a single rib and its associated struts during erection of the umbrella of FIG. 1, and FIGS. 7A to 7D are a series of close-up perspective views of the shaft, struts and sliders at various stages during erection of the umbrella of FIG. 1.
Figure 6A:
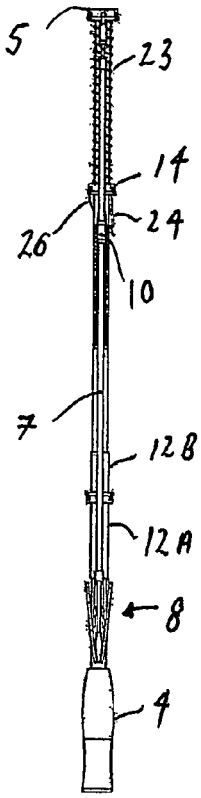

In FIGS. 3A, 4A and 6A the umbrella is shown in its fully collapsed state with ribs 6,7 lying substantially against or adjacent to shaft 2, canopy 3 removed for improved clarity and legs 16 and 17 of spreader 8 in a closed substantially "V" shaped formation.

Figure 3B:
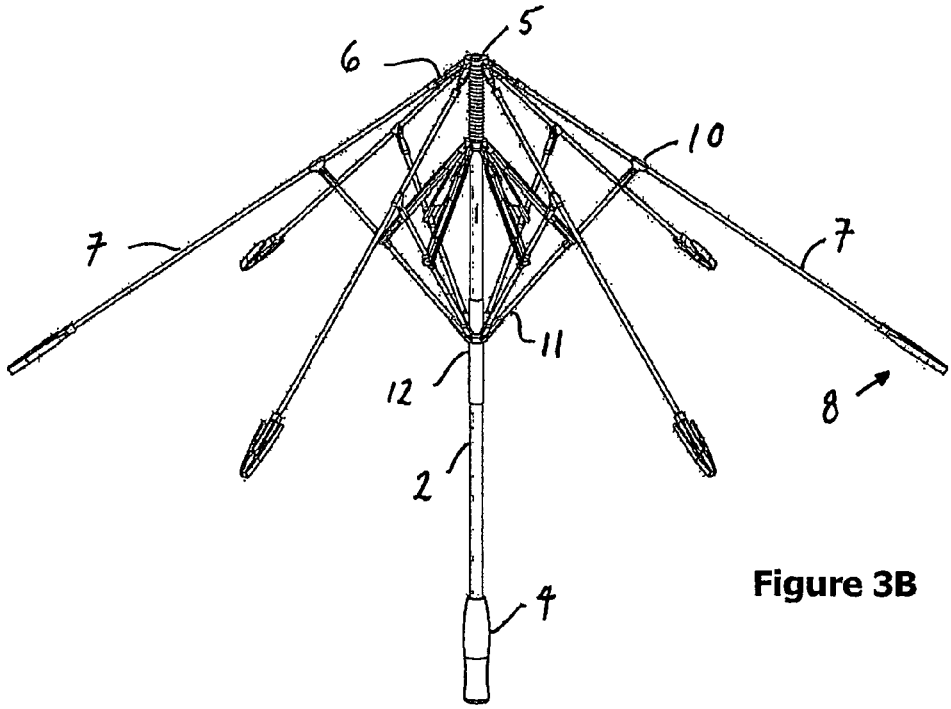
Figure 4B:
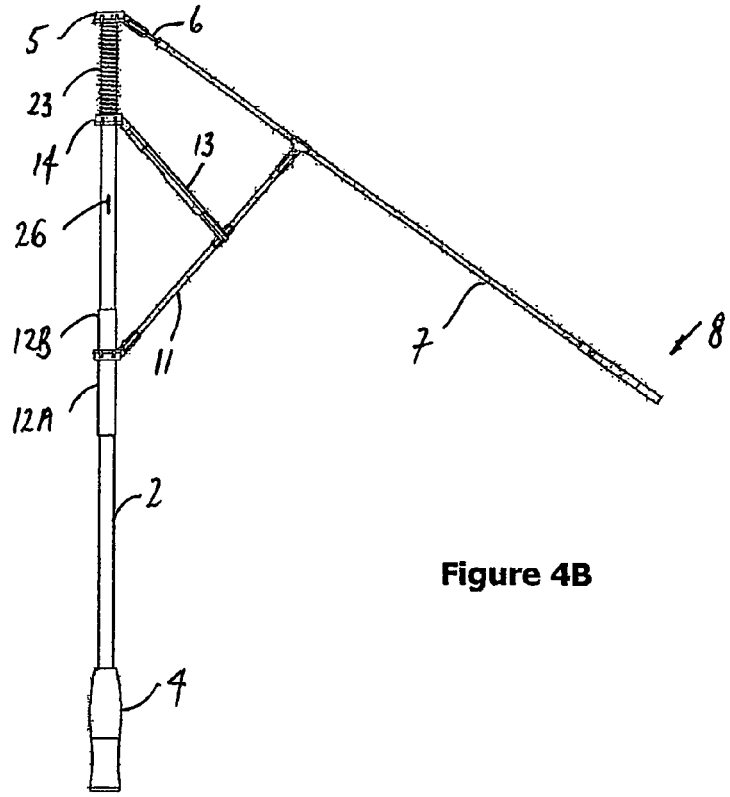
Figure 6B:
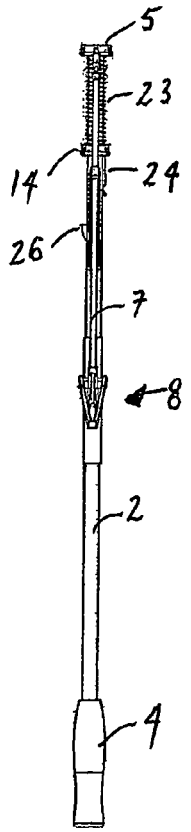
Figure 6C:
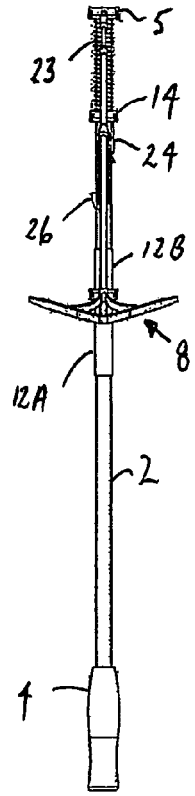

In FIGS. 3B, 4B and 6B the primary slider 12 has been moved upwards along shaft 2 to around the mid-point of shaft 2. It can be seen that the ribs 6,7 are being pivoted away from shaft 2 by primary struts 11. Secondary slider 14 is still some distance away from but being pushed towards end washer 5 by secondary struts 13. Legs 16 and 17 of spreader 8 have opened slightly when compared to their closed state shown in FIGS. 3A and 4A.

At this point spring 23 has been slightly compressed and is therefore providing some resistance to the upward movement of secondary slider 14. Ideally, the resistance provided would be sufficient to temporally halt upwards movement of secondary slider 14 however, as previously mentioned, a large spring constant for spring 23 would increase the amount of effort required by the user. Accordingly, in one embodiment of the umbrella which will be described below with reference to FIGS. 7A to 7D, means are provided for actively ensuring a temporary halt to secondary slider 14 at or around the position shown in FIGS. 3B, 4B and 6B.

Figure 3C:
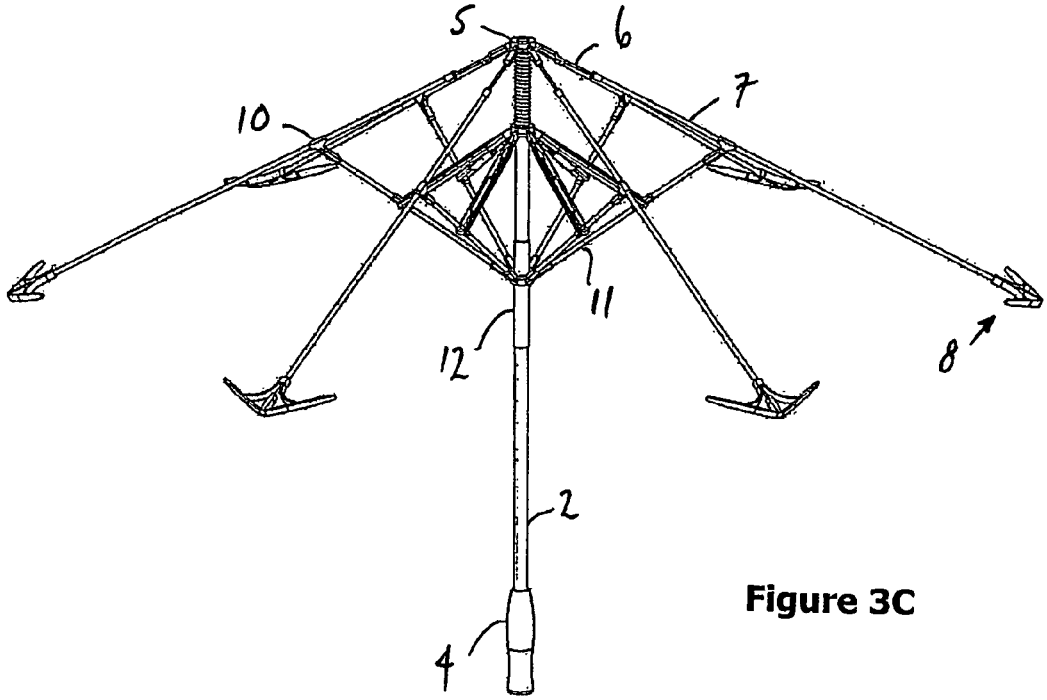
Figure 4C:
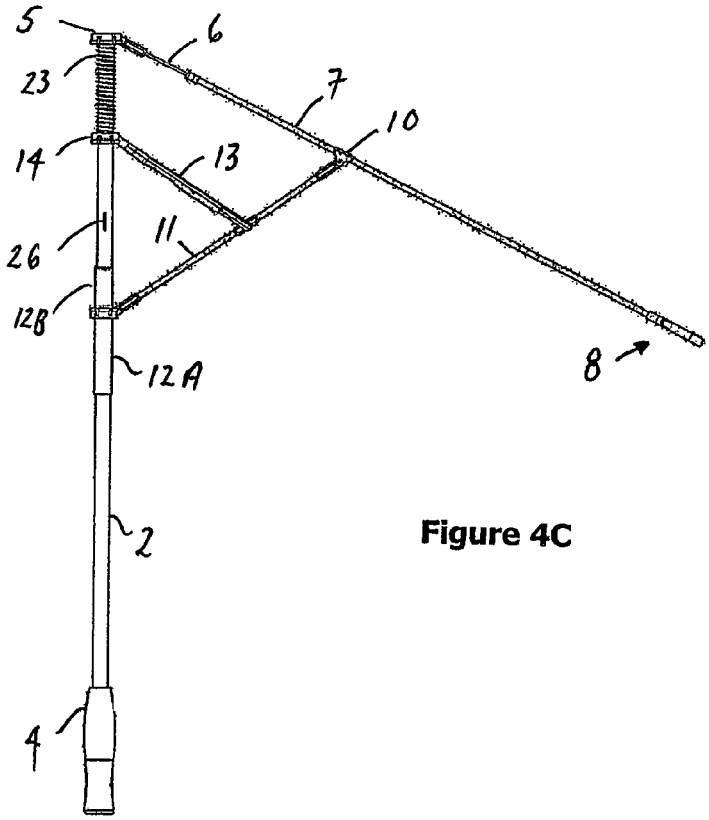

In FIGS. 3C, 4C and 6B secondary slider 14 is in the same position along the shaft as is shown in FIGS. 3B, 4B and 6B. Primary slider 12 is still being moved upwards towards its upper stop and therefore the ribs 6,7 are still rotating out from shaft 2. However, the inner ends of secondary struts 13 are now effectively fixed in position (because secondary slider 14 is temporarily "fixed") such that the secondary struts 13 are now limited to pivotal movement about their inner ends. The outer ends of secondary struts 13 therefore act as fulcrums to a substantially mid-point of primary struts 11 such that any further upward movement of primary slider 12 causes primary struts 11 to act as levers about these fulcrum points. As a result a mechanical advantage produces a resultant radial force at the outer ends of the primary struts 11 acting along the ribs 6. This resultant force acts upon the outer tubes 7 via couplings 10. It can also be seen that legs 16 and 17 of spreader 8 in FIGS. 3C and 6C have opened further than in FIGS. 3B and 6B.

Figure 3D:
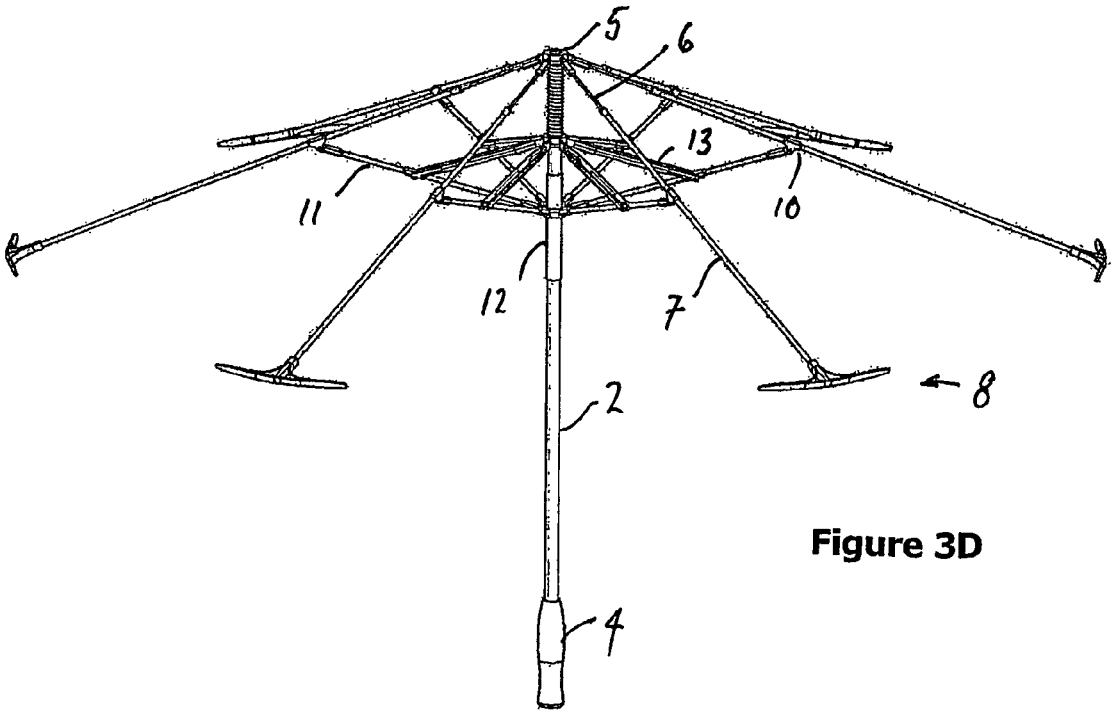
Figure 4D:
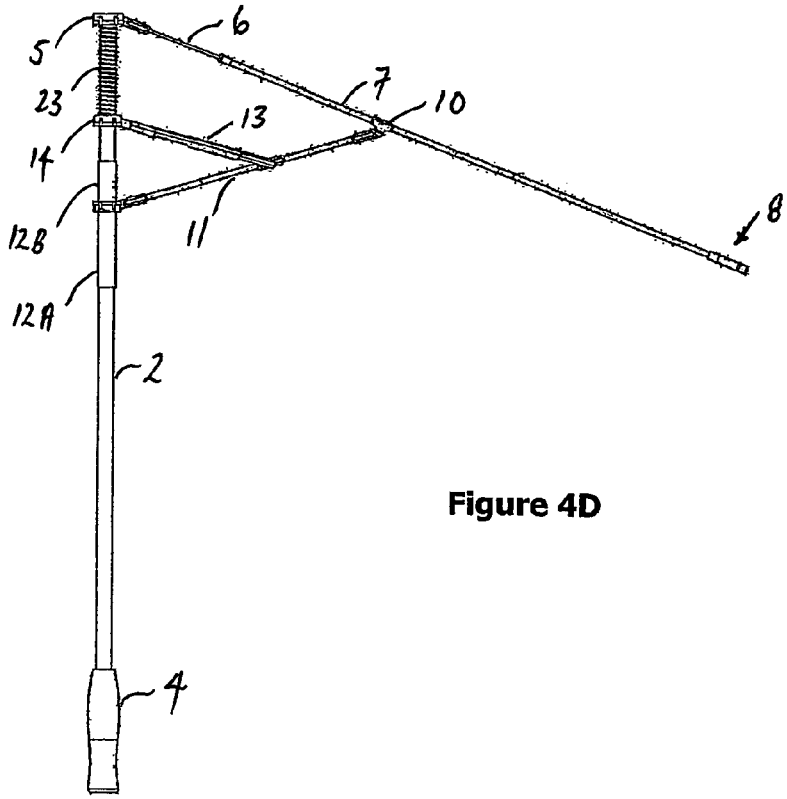
Figure 6D:
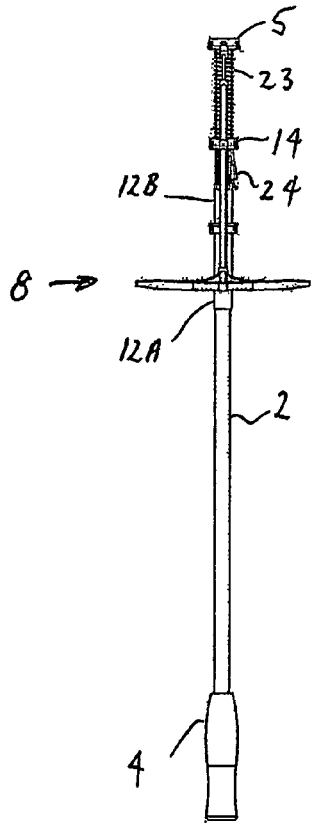

In FIGS. 3D, 4D and 6D it can be seen that the primary slider 12 has been moved further up shaft 2 towards end washer 5, secondary slider 14 has still not moved any further upward, ribs 6 have pivoted out further from shaft 2 and outer tubes 7 have been further displaced or slid along their respective inner rod 6, away from shaft 2. It can also be seen that legs 16 and 17 of spreader 8 are practically fully splayed so that the canopy (not shown) will be tensioned due to the radial force acting along outer tubes 7. It will also be noted that this radial force will be transferred to the canopy periphery (via a seam formed in each pocket 9 along the canopy's perimeter) along a line or load-spreading surface formed by legs 16 and 17 of spreader 8 rather than at a point as in conventional umbrellas.

Figure 3E:
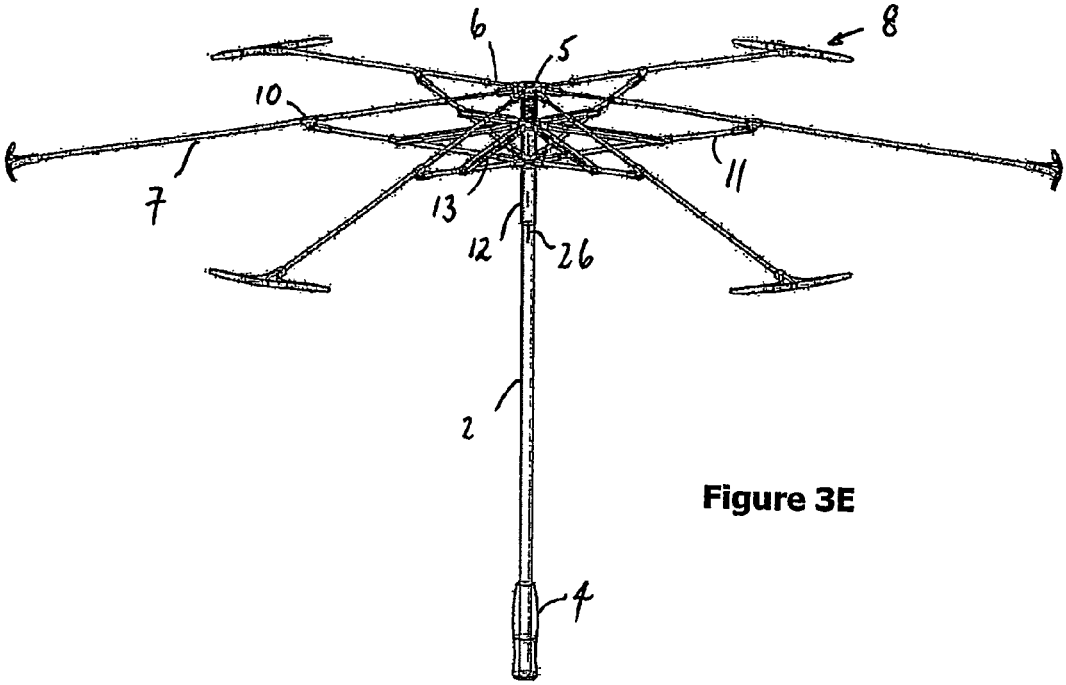
Figure 4E:
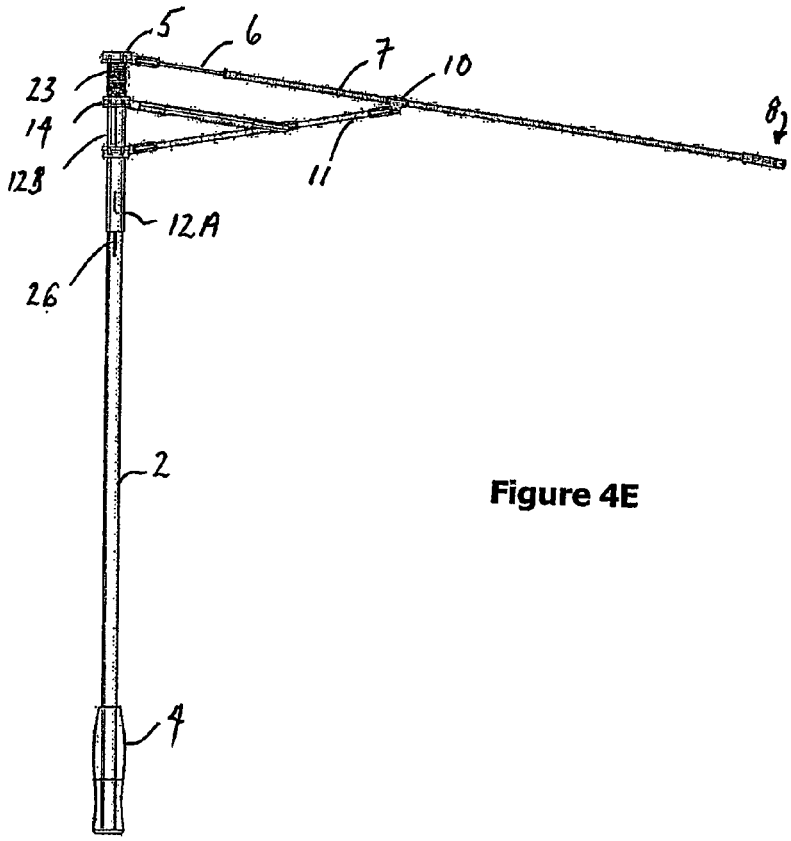
Figure 6E:
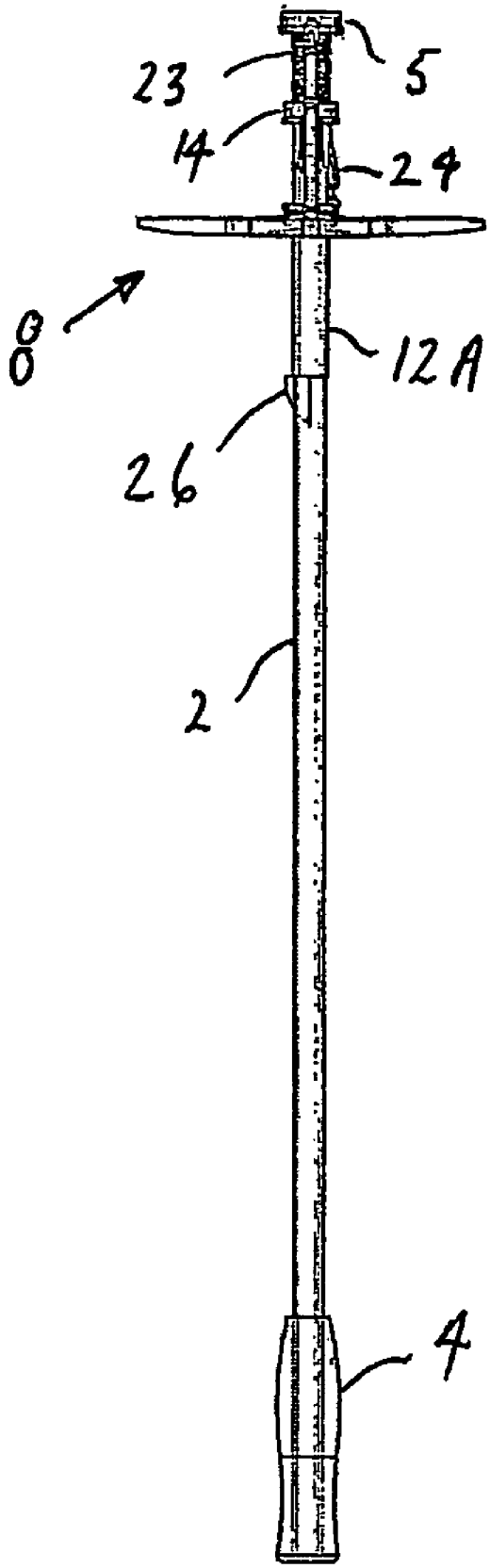

In FIGS. 3E, 4E and 6E it can be seen that secondary slider 14 has now moved further up shaft 2 and that the spring 23 is further compressed. This is the fully erected state of the frame and primary slider 12 has now caught up to and moved secondary slider 14 into its final position. The frame may be held or locked in this fully erected position by a conventional spring loaded shaft protrusion 26 which is withdrawable into the shaft to allow passage of primary slider 12 in the known way. Protrusion 26 then provides a backstop to downwards movement of primary slider 12 until depressed by a user.

The upper cylindrical spacing portion 12B of primary slider 12 acts to push secondary slider 14 upwards but also to fix the final spacing of the primary and secondary sliders. It can be seen that the secondary slider is positioned at about mid way between the primary slider and end washer 5. In the fully erect state shown in FIG. 4E it will be noted that the secondary strut 13 is substantially parallel with rib 6, 7 and that the shaft, primary strut 11 and secondary strut 13 form or approximate an isosceles triangle. It has been found that this resulting construction provides significant structural rigidity.

In this fully erected position, any additional upwards force on primary slider 12 is converted into tension in the canopy as the entire spreader 8 attempts to move radially outward, effectively attempting to increase the length of the umbrella's ribs. Equally, any external force such as a gust of wind acting beneath the canopy will find it difficult to invert (or blow inside-out) the umbrella because to do so would require primary struts 11 to rotate or move upwards which movement is resisted by secondary struts 13. In this position the periphery of the canopy 3 is tightened radially thereby increasing the strength of the umbrella structure and improving the rain-resistance ability of some canopy materials. Furthermore, because the outer tubes 7 are in compression they are less likely to buckle sideways which is required for the structure to invert.

With reference now to FIGS. 7A to 7D (note that the mechanism is also visible in FIGS. 6A to 6E), one embodiment of means for temporarily restraining upward movement of secondary slider 14 will now be described. It has been found that it is desirable to temporarily restrain the secondary slider before the canopy induces bending in the ribs and thereby increasing the frictional drag on the inner rods 6 through outer tubes 7. For example, secondary slider 14 could be temporarily restrained at about 10 cm from end washer 5.

Figure 7B:
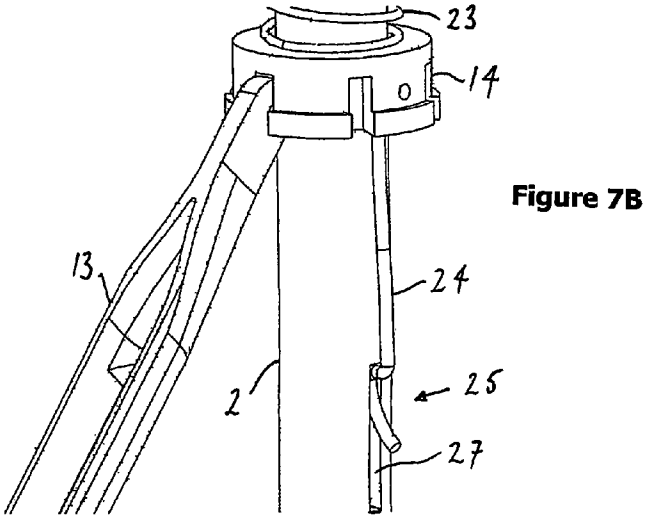
Figure 7D:
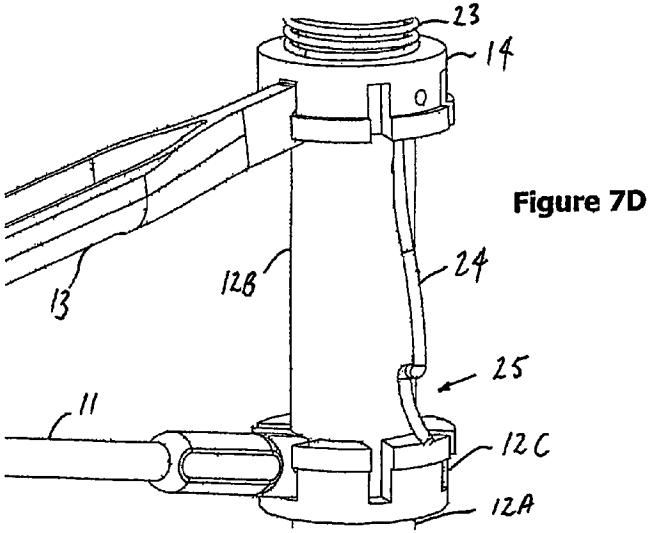
Figure 7A:
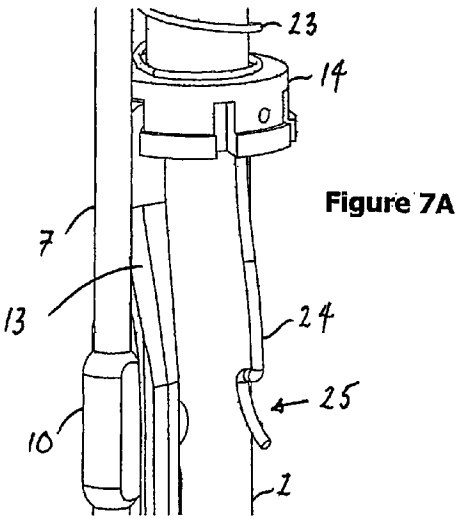

In FIGS. 7A to 7D, only a single primary strut 11 and single secondary strut 13 have been shown so that primary 12 and secondary 14 sliders include cavities which would ordinarily be occupied by ends of further struts. FIG. 7A corresponds to FIGS. 3A, 4A and 6A in which the frame is completely collapsed. A clip 24 is shown extending downwards from the lower surface of secondary slider 14. The clip 24 is preferably formed from an elastically resilient material such as a spring steel rod and is biased inwards towards shaft 2 so that a hook portion 25 contacts the outer surface of the shaft. Hook portion 25 is substantially "c" shaped although its upper section is substantially flat and a curved or camming section depends downwardly therefrom.

FIG. 7B corresponds to FIGS. 3B and 3C, 4B and 4C, and 6B and 6C. In FIG. 7B the hook portion 25 of clip 24 has slid upwards along shaft 2 until it has entered a slot 27. Due to the inwardly directed bias on clip 24 the hook is pushed into slot 27 and the upper, flat section of the hook catches on the upper edge of the slot, arresting movement of secondary slider 14 (which was moving upwards through the vertical component of force imparted via secondary strut 13 from its connection to primary strut 11 and primary strut 12).

Figure 7C:
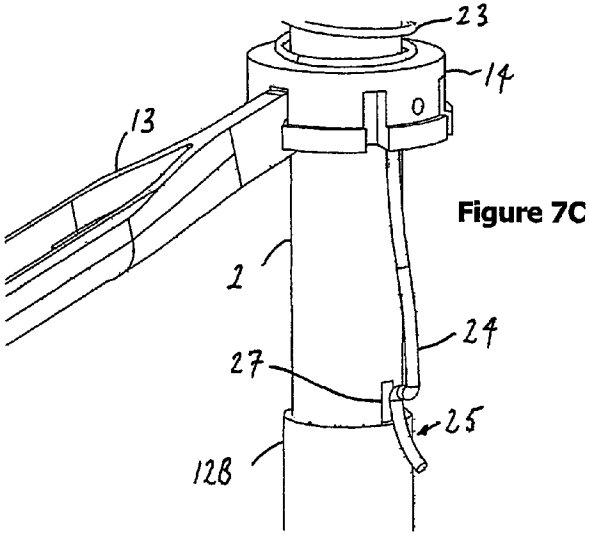

FIG. 7C corresponds to FIGS. 3D, 4D and 6D wherein the upper cylindrical spacer 12 of primary slider 12 reaches the hook portion 25 of clip 24 and through camming action along the downwardly directed curved section of the hook, dislodges the hook portion 25 from slot 27 so that secondary slider 14 is once again freely movable upwards on the shaft. Once the hook is dislodged the outer tubes 7 will have been radially displaced along their inner rods 6 before additional frictional drag is introduced by curved outer tubes/inner rods.

FIG. 7D corresponds to FIGS. 3E, 4E and 6E, wherein the umbrella is fully erected and the upper cylindrical spacer 12B has slid completely beneath clip 24 and is bearing against (and has moved upwardly) secondary slider 14.

During collapsing of the umbrella, the lower curved surface of hook portion 25 (which projects forward, past the axis of the clip) rides along the surface of the shaft and re-enters the slot 27 but is not trapped therein because the end of the hook will always project out of the slot. The lower curved surface of the hook then contacts the lower edge of the slot and emerges from the slot to continue its slide down along the shaft.

The spring loaded shaft protrusion 26 is also utilised during collapsing of the umbrella to stop the downwards movement of the secondary slider 14 which thereby initiates the retraction of the outer ribs along the inner rods 6. For this purpose the upper edge of protrusion 26 may be provided with a flat portion parallel to the lower surface of secondary slider 14. This allows secondary slider 14 to rest against protrusion 26 without any component of force being applied to the protrusion in a direction which would initiate retraction of the protrusion (that is, no force is directed towards the shaft). In contrast, the lower surface of protrusion 26 is preferably curved or cam-shaped to allow the primary slider 12 to pass the protrusion during umbrella erection, thereby retracting it within shaft 12.

As previously mentioned, canopy 3 is primarily attached to the umbrella frame by virtue of spreaders 8 being located within purpose-built pockets 9 provided at equally spaced locations around the periphery of the canopy. Additionally, the canopy could be fixed to the end of shaft 2 (to washer 5 for example) and/or connected to ribs 6,7 at some point along their length by for example ties (not shown) sewn into the underside of the canopy which may be tied or connected about each of the ribs. A preferred connection system could incorporate VELCRO® releasable fasteners comprising loops and hooks provided on respective opposing tie surfaces to allow the canopy to be easily removed should it be necessary or convenient to do so. Accordingly, a user could regularly replace or select a particular canopy for use with the umbrella frame according to the present invention which could easily be fitted or removed by the user without tools.

It will be appreciated that the present invention is applicable to rain umbrellas, sun or beach umbrellas and parasols and that the invention is equally applicable to collapsible shaft umbrellas or fixed shaft umbrellas. It should also be noted that aspects of the invention could be incorporated into other umbrella-like devices in which support ribs or arms are generally radially attached to a central post or pole such as in collapsible rotary clothes lines, tents or awnings/sun shades. In the case of collapsible rotary clothes line it would of course not be necessary to incorporate features such as the spreader at the end of each rib.

Aspects of the present invention have been described by way of example only and it should be appreciated that modifications and additions may be made thereto without departing from the scope thereof.

The invention claimed is:

1. An umbrella comprising:

a shaft, a plurality of rib members, first ends of said rib members spaced about and pivotally connected at or adjacent a first end of said shaft, a canopy comprising one or more pockets at or adjacent to the periphery of the canopy wherein an opening or openings in each pocket is accessible from the direction of the central portion of the canopy, a slider movable along the shaft to open or collapse the umbrella, a plurality of struts, each of which is pivotally connected between the slider and a rib member, a deployable force spreader provided on a second end of each rib member, the force spreader received within each of the pockets of the canopy, and a secondary slider movable along the shaft between said slider and the first end of said shaft, and a plurality of secondary struts each pivotally connected between said secondary slider and a respective strut, wherein each rib member comprises an inner rod extending from the shaft to the force spreader and an outer tube slidable on said inner rod wherein each outer tube is pivotally connected to a strut.

2. An umbrella as claimed in claim 1, wherein each force spreader comprises a load spreading surface adapted to transfer radial force from the outer tube of said rib member to the periphery of said canopy via said pocket.

3. An umbrella as claimed in claim 2, wherein the amount of contact between said canopy and said load spreading surface increases during erection of said umbrella.

4. An umbrella as claimed in claim 2, wherein said force spreader comprises two legs pivotally connected together at a pivot region and forming a substantially 'V' shape when said umbrella is in a collapsed state and wherein said legs are spread apart and substantially aligned during erection of said umbrella, the two legs and the pivot region forming said load spreading surface.

5. An umbrella as claimed in claim 4, wherein the outer end of each inner rod contacts the pivot region of a respective force spreader and the outer end of each outer tube is connected to both of the legs of a respective force spreader.

6. An umbrella as claimed in claim 4, wherein the outer end of each inner rod is received within a longitudinal bore provided in a stopper connected to or forming a part of the pivot region of each force spreader.

7. An umbrella as claimed in claim 4, wherein each force spreader comprises first and second spreading members, each pivotally connected to a respective pivotally connected leg and non-pivotally connected to a tube mounting hub of said force spreader, the tube mounting hub connected to the outer end of said outer tube, said inner rod passing through the tube mounting hub.

8. An umbrella as claimed in claim 4, wherein said force spreader is formed from a plastic material and wherein living hinges form the pivotal connections therein.

9. An umbrella as claimed in claim 1, wherein the inner rod comprises more than one abutable separate inner rod portions within an outer tube.

10. An umbrella as claimed in claim 9, wherein an inner rod portion furthest from the shaft has a lower weight per unit length than an inner rod portion closer to the shaft.

11. An umbrella frame comprising:

a shaft, a plurality of rib members, first ends of said rib members spaced about and pivotally connected at or adjacent a first end of said shaft, a primary slider movable along the shaft to erect or collapse the umbrella frame, a secondary slider movable along the shaft between the primary slider and the first end of the shaft, a plurality of primary struts, each of which is pivotally connected between the primary slider and a rib member, and a plurality of secondary struts, each of which is pivotally connected between the secondary slider and a primary strut, wherein each rib member comprises an inner rod extending from the shaft to a force spreader and an outer tube slidable on said inner rod wherein each outer tube is pivotally connected to a respective primary strut.

12. An umbrella frame as claimed in claim 11, wherein each force spreader is provided on a second end of each rib member.

13. An umbrella frame as claimed in claim 11, wherein said secondary struts are about half as long as the primary struts.

14. An umbrella frame as claimed in claim 11, wherein said secondary struts are about $^{15}/_{26}$ times the length of the primary struts.

15. An umbrella frame as claimed in claim 11, wherein each secondary strut is connected to a primary strut a predetermined distance from its connection with said primary slider, wherein said pre-determined distance is substantially equal to the length of said secondary strut.

16. An umbrella frame as claimed in claim 11, wherein the primary slider comprises a spacer above the position on the primary slider at which the primary struts are connected and which, during erection of the umbrella frame, contacts and pushes the secondary slider and once the umbrella frame has reached a fully erected state, fixes the spacing between the primary slider and secondary slider.

17. An umbrella frame as claimed in claim 11, wherein during erection of the umbrella frame, a holder temporarily holds the secondary slider in position at a predetermined location along the shaft before releasing the secondary slider once the primary slider has moved a predetermined distance towards the secondary slider.

18. An umbrella frame as claimed in claim 17, wherein each force spreader comprises a load spreading surface adapted to transfer radial force from the outer tube of said rib member to the periphery of a canopy adapted to be supported by the umbrella frame.

19. An umbrella frame as claimed in claim 18, wherein the effective length or contact area of said load spreading surface increases during erection of said umbrella frame.

20. An umbrella frame as claimed in claim 18, wherein each force spreader comprises two legs pivotally connected together at a pivot region and forming a substantially 'V' shape when said umbrella frame is in a collapsed state and wherein said legs are spread apart and substantially aligned during erection of said umbrella frame, the two legs and the pivot region forming said load spreading surface.

21. An umbrella frame as claimed in claim 20, wherein the outer end of each inner rod contacts the pivot region of a respective force spreader and the outer end of each outer tube is connected to both of the legs of a respective force spreader.

22. An umbrella frame as claimed in claim 20, wherein the outer end of each inner rod is received within a longitudinal bore provided in a stopper connected to or forming a part of the pivot region of a force spreader.

23. An umbrella frame as claimed in claim 20, wherein each force spreader comprises first and second spreading members, each pivotally connected to a respective pivotally connected leg and non-pivotally connected to a tube mounting hub of said force spreader, the tube mounting hub connected to the outer end of said outer tube, said inner rod passing through the tube mounting hub.

24. An umbrella frame as claimed in claim 20, wherein said force spreader is formed from a plastic material and wherein living hinges form the pivotal connections therein.

25. An umbrella frame as claimed in claim 17, wherein the inner rod comprises more than one abutable separate inner rod portions within an outer tube.

26. An umbrella frame as claimed in claim 25, wherein an inner rod portion furthest from the shaft has a lower weight per unit length than an inner rod portion closer to the shaft.

27. An umbrella frame as claimed in claim 11, wherein no more than six rib members are provided about said shaft.

28. An umbrella frame comprising:

a shaft, a plurality of rib members spaced about said shaft, each rib member comprising a first portion pivotally connected at or adjacent a first end of said shaft and a second portion freely slidable relative to said first portion, a slider movable along the shaft to erect or collapse the umbrella frame, and a plurality of struts, each of which is pivotally connected between the slider and the second portion of said rib member, wherein a force spreader is provided on the end of each rib member furthest from the shaft, and the first portion of each rib member comprises an inner rod extending from the shaft to a respective force spreader and an outer tube slidable on said inner rod wherein each outer tube is pivotally connected to a strut.

29. An umbrella frame as claimed in claim 28, further comprising a secondary slider movable along the shaft between said slider and the first end of said shaft, and a plurality of secondary struts each pivotally connected between said secondary slider and a respective strut.

30. An umbrella frame as claimed in claim 29, wherein said secondary struts are about half as long as the struts.

31. An umbrella frame as claimed in claim 30, wherein each secondary strut is connected to a strut a pre-determined distance from its connection with said slider, wherein said pre-determined distance is substantially equal to the length of said secondary strut.

32. An umbrella frame as claimed in claim 29, wherein said secondary struts are about 15/26 times the length of the struts.

33. An umbrella frame as claimed in claim 29, wherein the slider comprises a spacer above the position on the slider at which the struts are connected and which, during erection of the umbrella frame, contacts and pushes the secondary slider and once the umbrella frame has reached a fully erected state, fixes the spacing between the slider and secondary slider.

34. An umbrella frame as claimed in claim 29, wherein during erection of the umbrella frame, a holder temporarily holds the secondary slider in position at a predetermined location along the shaft before releasing the secondary slider once the slider has moved a predetermined distance towards the secondary slider.

35. An umbrella frame as claimed in claim 28, wherein each force spreader comprises a load spreading surface adapted to transfer radial force from the outer tube of said rib member to the periphery of a canopy adapted to be supported by the umbrella frame.

36. An umbrella frame as claimed in claim 35, wherein the effective length or contact area of said load spreading surface increases during erection of said umbrella frame.

37. An umbrella frame as claimed in claim 36, wherein each force spreader comprises two legs pivotally connected together at a pivot region and forming a substantially 'V' shape when said umbrella frame is in a collapsed state and wherein said legs are spread apart and substantially aligned during erection of said umbrella frame, the two legs and the pivot region forming said load spreading surface.

38. An umbrella frame as claimed in claim 37, wherein the outer end of an inner rod contacts the pivot region of a force spreader and the outer end of an outer tube is connected to both of the legs of said force spreader.

39. An umbrella frame as claimed in claim 37, wherein the outer end of an inner rod is received within a longitudinal bore provided in a stopper connected to or forming a part of the pivot region of a respective force spreader.

40. An umbrella frame as claimed in claim 37, wherein each force spreader comprises first and second spreading members, each pivotally connected to a respective pivotally connected leg and non-pivotally connected to a tube mounting hub of said force spreader, the tube mounting hub connected to the outer end of said outer tube, said inner rod passing through the tube mounting hub.

41. An umbrella frame as claimed in claim 37, wherein said force spreader is formed from a plastic material and wherein living hinges form the pivotal connections therein.

42. An umbrella frame as claimed in claim 28, wherein the inner rod comprises more than one abutable separate inner rod portions within an outer tube.

43. An umbrella frame as claimed in claim 42, wherein an inner rod portion furthest from the shaft has a lower weight per unit length than an inner rod portion closer to the shaft.

44. An umbrella frame as claimed in claim 28, wherein no more than six rib members are provided about said shaft.

45. An umbrella comprising a canopy supported by an umbrella frame as claimed in claim 11 or claim 28.

46. An umbrella as claimed in claim 45, wherein the canopy comprises one or more pockets at or adjacent to the periphery of the canopy wherein an opening or openings in each pocket is accessible from the direction of the central portion of the canopy.

47. An umbrella as claimed in claim 46, wherein the inside of each pocket, at least opposite to the opening, is closed to provide a bearing surface upon which the force spreader contacts.

48. An umbrella as claimed in claim 46, wherein each force spreader is provided on the end of each rib member furthest from the shaft, said canopy comprises a plurality of separate pockets spaced about the canopy's periphery, and wherein one force spreader is received within each pocket.

49. An umbrella as claimed in claim 48, wherein a closed edge of each pocket lies along the periphery of the canopy and the opening in each pocket is in the form of a slit substantially aligned with its rib member.

50. An umbrella comprising:

a shaft, a plurality of rib members, first ends of said rib members spaced about and pivotally connected at or adjacent a first end of said shaft, a canopy comprising one or more pockets at or adjacent to the periphery of the canopy wherein an opening or openings in each pocket is accessible from the direction of the central portion of the canopy, a slider movable along the shaft to open or collapse the umbrella, a plurality of struts, each of which is pivotally connected between the slider and a rib member, and a force spreader provided on a second end of each rib member, each force spreader received within one of the pockets of the canopy and comprising first and second legs pivotally connected at a pivot, wherein the force spreader is deployable from a collapsed state wherein the legs of the force spreader are in a compressed state within each pocket to an expanded state wherein the legs of the force spreader are splayed within each pocket, the splayed legs forming a load bearing edge against the periphery of the canopy within the pocket to tension the canopy upon reconfiguring the umbrella from a collapsed state to an open state using the slider.

51. An umbrella according to claim 50 wherein each rib member comprises a first member slidable relative to a second member, the second member being pivotally connected to the shaft, each force spreader being provided on an end of a respective first member, wherein movement of the first member relative to a respective second member away from the shaft deploys the force spreader to an expanded state.

52. An umbrella according to claim 51 wherein the force spreader comprises a mounting hub for mounting the force spreader on an end of a respective first member, and third and fourth legs coupled between the mounting hub and the first and second legs, respectively, wherein movement of the first member away from the shaft splays the first and second legs via the hub and the third and fourth legs /into the expanded state.

53. An umbrella according to claim 52 wherein movement of the first member towards the shaft retracts the first and second legs via the hub and the third and fourth legs into the collapsed state.

54. An umbrella according to claim 50 wherein the pivot is supported at or near the periphery of the canopy directly or indirectly by the rib member between the splayed legs.

55. An umbrella according to claim 50 wherein the legs extend from either side of the pivot such that the load bearing edge extends continuously from one leg to the other leg against the periphery of the canopy.

56. An umbrella according to claim 50 wherein the load bearing edge is arc-shaped.

57. An umbrella as claimed in claim 50, wherein the inside of each pocket, at least opposite to the opening, is closed to provide a bearing surface upon which the force spreader contacts.

58. An umbrella as claimed in claim 50, or claim 57, comprising a plurality of separate pockets spaced about the canopy's periphery, wherein one force spreader is received within each pocket.

59. An umbrella as claimed in claim 58, wherein a closed edge of each pocket lies along the periphery of the canopy and the opening in each pocket is in the form of a slit substantially aligned with its rib member.

60. An umbrella as claimed in claim 58, wherein the periphery of each pocket is closed.

61. An umbrella as claimed in claim 50, further comprising a secondary slider movable along the shaft between said slider and the first end of said shaft, and a plurality of secondary struts each pivotally connected between said secondary slider and a respective strut.

62. An umbrella as claimed in claim 61, wherein said secondary struts are about half as long as the struts.

63. An umbrella as claimed in claim 61, wherein said secondary struts are about $^{15}/_{26}$ times the length of the struts.

64. An umbrella as claimed in claim 61, wherein each secondary strut is connected to a strut a pre-determined distance from its connection with said slider, wherein said predetermined distance is substantially equal to the length of said secondary strut.

65. An umbrella as claimed in claim 61, wherein the slider comprises a spacer above the position on the slider at which the struts are connected and which, during erection of the umbrella, contacts and pushes the secondary slider and once the umbrella has reached a fully erected state, fixes the spacing between the slider and secondary slider.

66. An umbrella as claimed in claim 61, wherein during erection of the umbrella, a holder temporarily holds the secondary slider in position at a predetermined location along the shaft before releasing the secondary slider once the slider has moved a predetermined distance towards the secondary slider.

67. An umbrella as claimed in claim 50, wherein no more than six rib members are provided about said shaft.

* * * * *